US008887822B2

(12) United States Patent
Polan

(10) Patent No.: US 8,887,822 B2
(45) Date of Patent: Nov. 18, 2014

(54) FLEXIBLE DRY SPRINKLERS

(75) Inventor: George Polan, Liberty, SC (US)

(73) Assignee: Reliable Automatic Sprinkler Co., Inc., Liberty, SC (US)

( * ) Notice: Subject to any disclaimer, the term of this patent is extended or adjusted under 35 U.S.C. 154(b) by 156 days.

(21) Appl. No.: 13/486,904

(22) Filed: Jun. 1, 2012

(65) Prior Publication Data

US 2013/0319696 A1 Dec. 5, 2013

(51) Int. Cl.
*A62C 37/08* (2006.01)

(52) U.S. Cl.
USPC ..... 169/37; 169/16; 169/17; 169/20; 169/38; 169/57; 239/209; 239/588; 248/75; 285/114; 285/116

(58) Field of Classification Search
USPC ..... 169/16, 17, 19, 20, 37, 38, 54, 42, 56, 169/57; 239/208, 209, 588; 52/39, 506.07; 248/56, 75, 343; 285/45, 114, 116
See application file for complete search history.

(56) References Cited

U.S. PATENT DOCUMENTS

| | | | | | |
|---|---|---|---|---|---|
| 3,857,277 | A | | 12/1974 | Moore | |
| 4,217,961 | A | * | 8/1980 | Wotton | 169/41 |
| 4,570,719 | A | | 2/1986 | Wilk | |
| 4,854,388 | A | * | 8/1989 | Wyatt | 169/37 |
| 4,991,655 | A | | 2/1991 | McHugh | |
| 5,154,232 | A | | 10/1992 | McHugh | |
| 5,297,635 | A | | 3/1994 | McHugh | |
| 5,327,976 | A | * | 7/1994 | Hattori | 169/16 |
| 5,390,744 | A | | 2/1995 | McHugh | |
| 5,570,745 | A | | 11/1996 | MacDonald, III | |
| 5,743,337 | A | | 4/1998 | MacDonald, III | |
| 5,775,431 | A | | 7/1998 | Ondracek | |
| 5,842,526 | A | * | 12/1998 | Archer et al. | 169/37 |
| 5,967,240 | A | | 10/1999 | Ondracek | |
| 6,119,784 | A | | 9/2000 | MacDonald, III et al. | |
| 6,123,154 | A | | 9/2000 | MacDonald, III et al. | |
| 6,158,519 | A | | 12/2000 | Kretschmer | |
| 6,164,324 | A | | 12/2000 | Gradle | |
| 6,336,509 | B1 | * | 1/2002 | Polan et al. | 169/38 |
| 6,488,097 | B1 | | 12/2002 | MacDonald, III et al. | |
| 6,491,109 | B2 | | 12/2002 | Christenson et al. | |
| 6,526,907 | B1 | | 3/2003 | Donehue | |
| 6,752,218 | B2 | | 6/2004 | MacDonald, III et al. | |

(Continued)

FOREIGN PATENT DOCUMENTS

| | | | | |
|---|---|---|---|---|
| DE | 3919638 | C1 | | 11/1990 |
| JP | 05-137810 | A | | 1/1993 |
| JP | 06-170008 | A | | 6/1994 |
| WO | WO0154772 | | * | 8/2001 |

*Primary Examiner* — Steven J Ganey
(74) *Attorney, Agent, or Firm* — Fitzpatrick, Cella, Harper & Scinto

(57) ABSTRACT

A flexible dry sprinkler includes a flexible tube having an inlet attached to a first end, the inlet defining an inlet orifice operatively sealed by an inlet seal assembly. An outlet is attached to the second end of the flexible tube, and defines an outlet orifice operatively sealed by an outlet seal assembly. A flexible linkage extends from the inlet to the outlet through the flexible tube, and is constructed to operatively release the inlet seal assembly responsive to axial translation of the flexible linkage from a first position to a second position. The flexible linkage is supported by the outlet seal assembly in the first position and wherein the flexible linkage is constructed to axially translate toward the outlet when the outlet seal assembly is released.

21 Claims, 5 Drawing Sheets

(56) References Cited

U.S. PATENT DOCUMENTS

| | | | | |
|---|---|---|---|---|
| 6,851,482 | B2 | 2/2005 | Dolan | |
| 6,860,331 | B2 | 3/2005 | Hagen et al. | |
| 6,907,938 | B2 | 6/2005 | MacDonald, III et al. | |
| 7,032,680 | B2 | 4/2006 | MacDonald, III et al. | |
| 7,143,834 | B2 | 12/2006 | Dolan | |
| 7,293,576 | B2 | 11/2007 | Royse | |
| 7,296,634 | B2 | 11/2007 | MacDonald, III et al. | |
| 7,373,720 | B1 | 5/2008 | Jensen et al. | |
| 7,559,376 | B2 | 7/2009 | Silva, Jr. | |
| 7,921,928 | B2 | 4/2011 | Thompson et al. | |
| 8,336,920 | B2 * | 12/2012 | Stempo et al. | 285/114 |
| 2003/0075343 | A1 | 4/2003 | Ballard | |
| 2005/0284644 | A1 | 12/2005 | MacDonald, III et al. | |
| 2007/0039743 | A1 | 2/2007 | MacDonald, III et al. | |
| 2007/0095548 | A1 | 5/2007 | MacDonald, III et al. | |
| 2008/0196906 | A1 | 8/2008 | Nusbaum | |
| 2008/0277124 | A1 | 11/2008 | Johnston et al. | |
| 2010/0038099 | A1 * | 2/2010 | Thompson et al. | 169/37 |

* cited by examiner 7
y
2
10
47
48
43
5
45
45c
45b
44
10b
45a
zz
46a
46
50b
zz
54
53
50
50a
56
42
55
51
52
51a
y

FLEXIBLE DRY SPRINKLERS

BACKGROUND

Dry sprinklers are used in areas that are exposed to freezing conditions, such as in freezers or walkways that may experience freezing conditions. In some dry-pipe systems supply conduits run in a space where the fluid in the supply conduit is not subject to freezing. A dry sprinkler is attached to the supply conduit and extends into a space where the fluid would otherwise be subject to freezing.

The typical construction of a dry sprinkler comprises a sprinkler head, a tube, a pipe connector at the inlet end of the tube (for connecting the inlet end to the pipe network of the fire suppression system), a plug seal at the inlet end to prevent water from entering the tube until it is necessary to actuate the sprinkler, and an actuating mechanism to maintain the plug seal at the inlet end until actuation. Typically, the sprinkler head is attached to the end of the tube opposite to the inlet end of the tube. Also, the tube is conventionally vented to the atmosphere to allow drainage of any condensate that may form in the tube.

Examples of dry sprinklers are generally disclosed in U.S. Pat. No. 5,775,431 to Ondracek and U.S. Pat. No. 5,967,240 to Ondracek. As shown generally in these patents, the actuating mechanism can be a rod or other similar structure that extends through the tube between the sprinkler head and the inlet end to maintain the seal at the inlet end. The actuating mechanism includes a thermally responsive support element at the sprinkler head that supports the rod and therefore the seal at the inlet end. In some sprinklers, the tube is also sealed at the sprinkler head end of the tube and the actuating mechanism is supported at the sprinkler head end by a seal cap supported by the thermally responsive support element. In such arrangements, the space in the tube between the two seal caps can be pressurized with a gas, such as dry air or nitrogen or with a liquid such as an antifreeze solution. When an elevated temperature is experienced, the thermally responsive support element fails releasing the plug seal (and also any lower seal at the sprinkler head end of the tube) to allow water from the supply conduit to flow into and through the tube to the sprinkler head, whereupon the fluid is distributed by the sprinkler head.

Conventional dry sprinklers are fabricated using a rigid tube having a seal at the inlet that is separated from the sprinkler's temperature sensor, which is intended to be positioned in an area exposed to freezing conditions, such as an area that is not heated. The rigid tube extends into the unheated area from a wet pipe system (located in a heated area) and must be precisely aligned and installed while avoiding various architectural, structural and mechanical obstructions typically found in commercial or industrial buildings.

SUMMARY

To remedy some of the problems and difficulties noted above, a dry sprinkler is provided which has a flexible tube. The dry sprinkler includes an inlet having an inlet orifice sealed by an inlet seal assembly and having a release mechanism for selectively releasing the inlet seal assembly. The dry sprinkler also includes a flexible tube attached to the inlet at a first end of the flexible tube. The dry sprinkler includes a flexible linkage extending longitudinally within the flexible tube between the inlet and outlet, the flexible linkage constructed to operatively release the release mechanism in response to axial translation of the flexible linkage. The dry sprinkler also includes an outlet attached to the flexible tube, the outlet including a fire sprinkler portion having a thermally responsive element constructed to support an outlet seal assembly in an unresponsive state. In a case where the thermally responsive element is in a responsive state, the outlet seal assembly is released and the flexible linkage translates in an outlet direction at least an inlet stroke distance to activate the release mechanism to release the inlet seal assembly.

DETAILED DESCRIPTION

Figure 1:
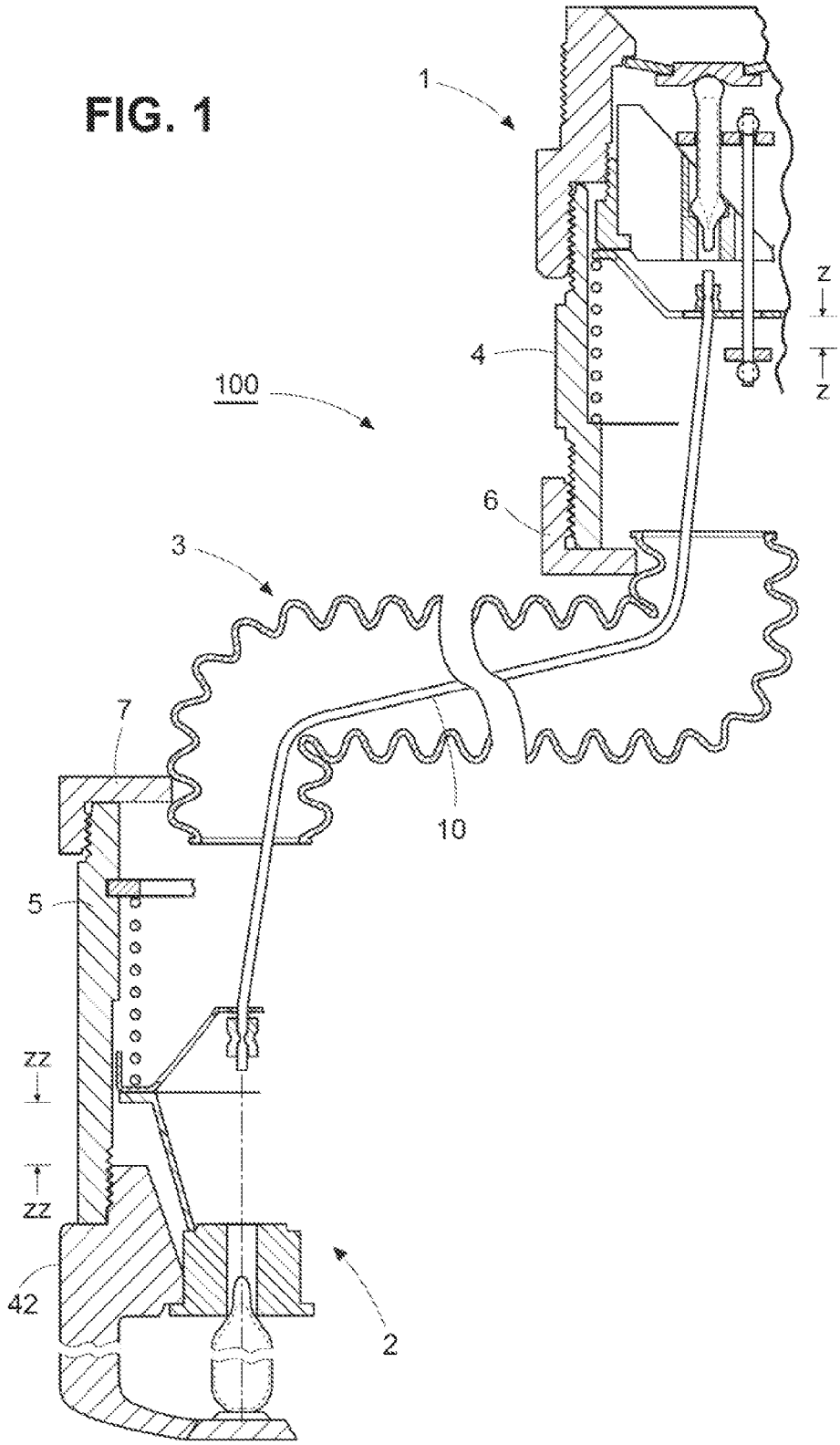
FIG. 1 shows a fire sprinkler system which includes a dry sprinkler in accordance with an embodiment of the invention.

One aspect of the present disclosure is a flexible dry fire protection sprinkler. One embodiment of such a dry fire protection sprinkler 100 is shown in FIG. 1. The sprinkler 100 includes an inlet 1, a flexible tube 3, and an outlet 2. The flexible tube 3 extends between the inlet 1 and outlet 2 and is in mechanical and fluid communication therewith. The flexible tube 3 also has an inlet end 6 connected to an inlet biasing portion 4 of the inlet 1 by a threaded connection and also has an outlet end 7 connected to an outlet biasing portion 5 of the outlet 2 by a threaded connection. A flexible linkage 10 extends through the flexible tube 3 between the inlet 1 and the outlet 2. The flexible linkage 10 is retained at its ends by the inlet biasing portion 4 and the outlet biasing portion 5 as discussed in further detail below.

The following description relates to an example embodiment with reference to the appended drawings and refers to directions including "inlet" and "outlet". As used herein, the phrase "inlet direction" refers to a generally axial direction that is from the outlet 2 and toward the inlet 1 of the sprinkler 100 while the phrase "outlet direction" refers to a generally axial direction that is from the inlet 1 toward the outlet 2 of the sprinkler 100.

In one embodiment the flexible tube 3 is formed as a corrugated metal hose constructed similarly to that of conventional corrugated natural gas appliance hose. The flexible tube 3 has a nominal hose diameter between 0.8 to 1 inch. The flexible tube 3 can be bent into two opposing 90 sections, i.e., folded in shallow Z- or S-shapes.

Figure 2:
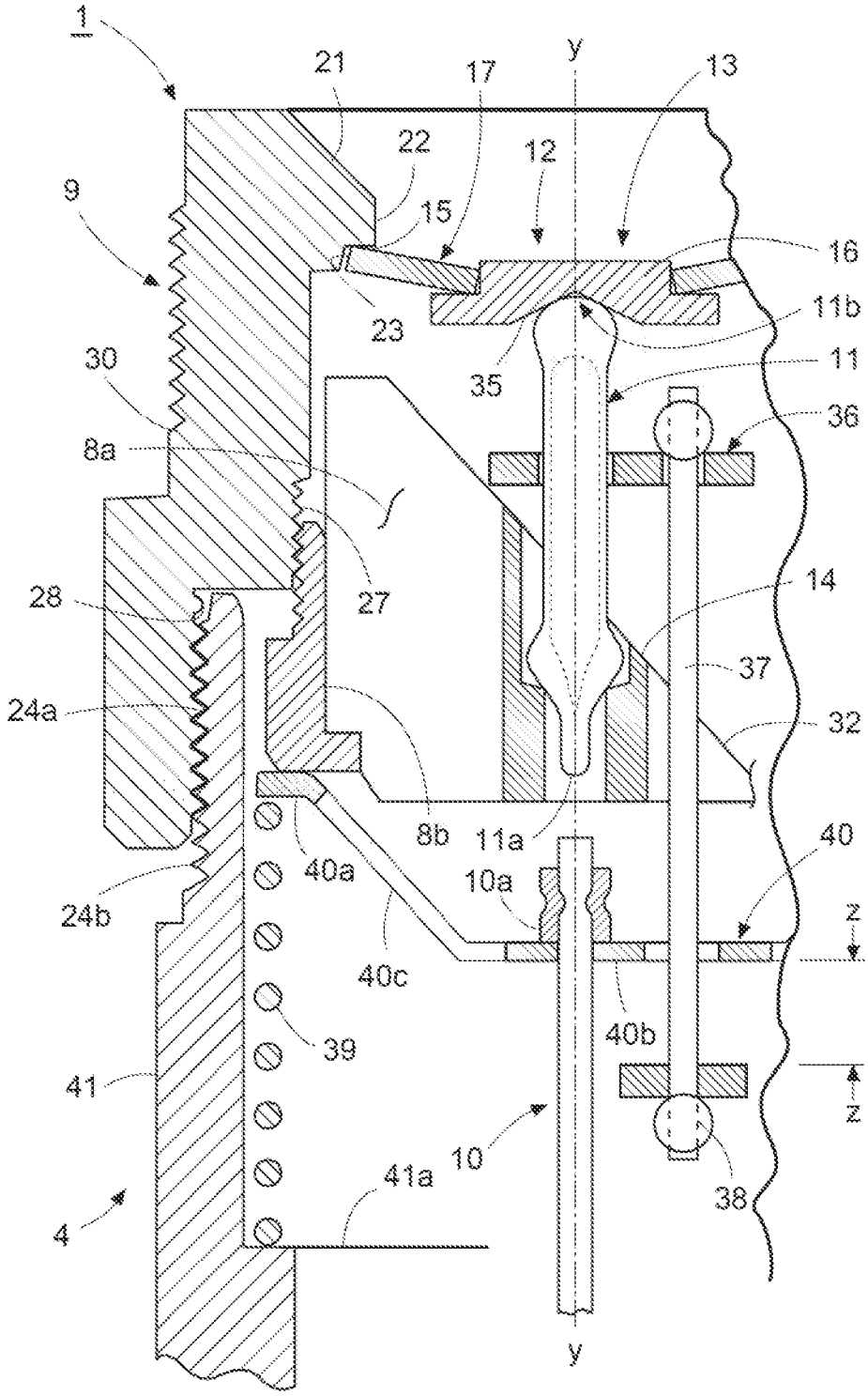
FIG. 2 shows an exploded cutaway section view through an inlet of the dry sprinkler shown in FIG. 1.

As shown in greater detail in FIG. 2, the inlet 1 includes an inlet connection portion 9 and the inlet biasing portion 4. The inlet connection portion 9 includes a fitting 30 constructed with external threads to mate with female threads of a fluid supply to fluidly couple the flexible dry sprinkler 100 to a source of pressurized fluid, such as water. The fitting 30 has internal threads 24*a* at its outlet end for mating with external threads 24*b* of the inlet biasing portion 4.

The internal surface of the fitting 30 has a stepped cross-sectional profile. Beginning at its inlet end, the fitting 30 has a frustoconical surface 21 that tapers radially inwardly toward an inlet orifice 12. In one embodiment, the angle of the frustoconical surface 21 with respect to the axis Y-Y is about 40 degrees. Adjacent to the frustoconical surface 21 in the outlet direction is a first cylindrical surface 22 which surrounds the inlet orifice. Adjacent to the first cylindrical surface 22 is a second cylindrical surface 23 and cap assembly sealing flange 15. The second cylindrical surface 23 has a diameter that is at least as large as the diameter of spring washer 17 when the spring washer 17 is in a compressed state. The second cylindrical surface 23 extends to a yoke connection section 27, which has internal threads for mating with external threads of a threaded yoke support ring 8*b*. The internal threads of the connection section 27 extend about 0.3 inch axially and the nominal diameter of the threads is 1 inch.

Adjacent to the yoke connection section 27 in the outlet direction is a first biasing portion connection section 28 that has a diameter that is larger than that of the yoke connection section 27. The first biasing portion connection area 28 extends axially about 0.5 inch to the outlet end of the inlet connection portion. The first biasing portion connection area 28 is configured with internal threads for mating with external threads of the first biasing portion 4 of tube 10.

A notch 34 is formed at the outlet end of the yoke support ring 8*b*. The notch 34 is constructed to receive a tool or other device to apply torque to the yoke support ring 8*b* so that the fitting 30 and the yoke support ring 8*b* can be threaded onto each other to apply compression to a glass bulb 11.

In an inactivated state of the dry sprinkler 100, the inlet orifice 12 is sealed by an inlet sealing cap assembly 13. The inlet sealing cap assembly 13 includes an inlet sealing cap 16 and annular spring washer 17, such as a Belleville spring washer. In the inactivated state of the dry sprinkler 100 the annular spring washer 17 is sealed between the sealing cap 16 and the cap assembly sealing flange 15 of the inlet fitting 30. The arrangement and operation of the inlet sealing cap assembly 13 will be described in greater detail herein below.

In the inactivated state of the dry sprinkler 100, the cap 16 supports the annular spring washer 17 against the fitting 30. The inlet sealing cap assembly 13 is supported in a sealed position by the aforementioned glass bulb 11, which is interposed between the inlet sealing cap assembly 13 and a multi-legged yoke 8*a*, which is itself supported by the fitting 30 via the aforementioned yoke support ring 8*b* threadably connected to the fitting 30.

The glass bulb 11 can be empty or filled with a thermally responsive fluid, and in one embodiment the bulb 11 has a nominal length of 20 mm. The glass bulb 11 is oriented substantially longitudinally and coaxially with the fitting 30 and the inlet biasing portion 10. The glass bulb 11 is seated with its outlet "pip" end 11*a* in a seat 14 formed in the yoke 8*a*. At its inlet end the glass bulb 11 is formed having a rounded end 11*b* termed the "pivot point". The inlet sealing cap assembly 13 has a conical groove 35 formed in the center of the cap 16 in which the pivot point 11*b* of the glass bulb 11 is seated.

In the inactivated condition, the annular spring washer 17 is compressed against the annular sealing flange 15 by threading the yoke support ring 8*b* relative to the fitting 30, thereby sealing the flow path of fluid through the inlet orifice 12. The annular spring washer 17 is compressed by the bulb 11 to sufficient deflection capable of surviving a hydrostatic test pressure between 600 pounds per square inch and 700 pounds per square inch. Thus, it is possible to assemble the fitting 30, inlet sealing cap assembly 13, yoke 8*a*, yoke support ring 8*b*, and glass bulb 11 together as a modular assembly comprising the inlet connection portion 9 of the inlet 1.

Figure 5:
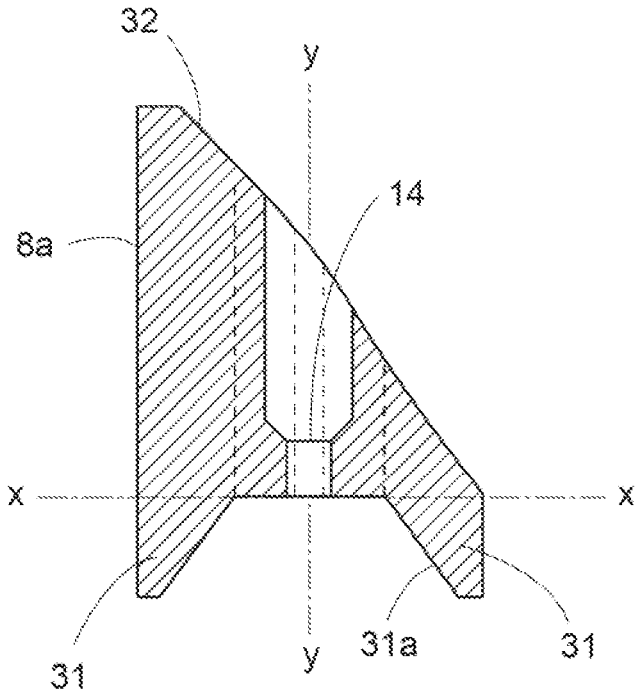
FIG. 5 shows a section view of the yoke along section A-A in FIG. 3.

The multi-legged yoke 8*a* is supported by yoke support ring 8*b* which is threaded into and retained by the inner wall of the fitting 30. The multi-legged yoke 8*a* is shown in greater detail in FIG. 5 which shows a view along section A-A in FIG. 3. At its outlet end, the multi-legged yoke 8*a* has a plurality of circumferentially spaced legs 31, termed "flutes". The flutes 31 are circumferentially spaced to permit the flow of fluid past the yoke 8*a* and to minimize the restriction of fluid flow. The flutes 31 are also circumferentially spaced to capture the sealing cap assembly 13 upon its release, as described further below. As shown in FIG. 5, the radially inner edge 31*a* of each flute is angled about 50 degrees with respect to axis Y-Y. Each flute extends in the axial direction between 0.180 inch and 0.260 inch.

At its inlet end, the multi-legged yoke 8*a* has an angled edge 32 with respect to the axis Y-Y. In one embodiment, the angled edge 32 is angled about 40 degrees with respect to the horizontal axis X-X. The seat 14 for the glass bulb 11 is coaxial with the multi-legged yoke 8*a* and the seat 14 is intersected by the angled edge 32. The diameter of the multi-legged yoke 8*a* is about 0.934 inch and the diameter of the bulb seat 14 is about 0.156 inch. The overall axial dimension of the multi-legged yoke 8*a* is about 1 inch.

Figure 3:
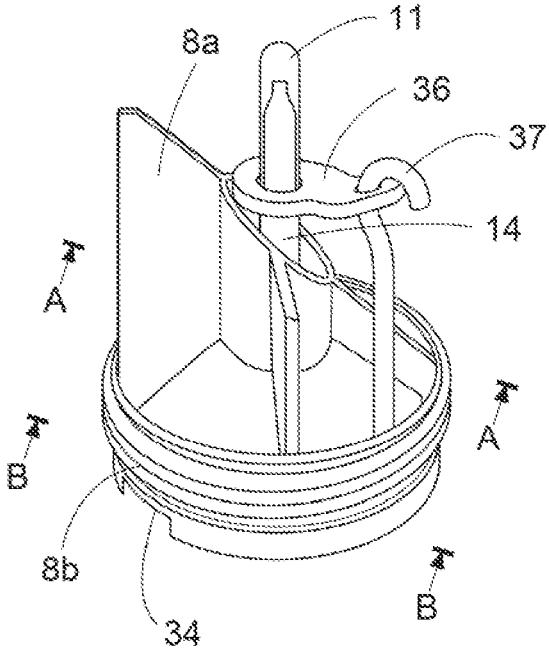
FIG. 3 shows an isometric view of a yoke, O-collar, linkage, and glass bulb disposed in the inlet shown in FIG. 1, viewed from the top and side of the yoke.
Figure 6:
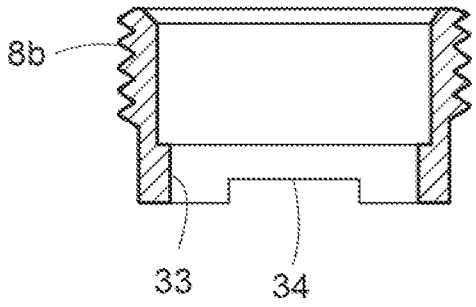
FIG. 6 shows a section view of a yoke retaining ring along section B-B in FIG. 3.

FIG. 6 shows a detailed section view of the yoke support ring 8*b* along section B-B shown in FIG. 3. The yoke support ring 8*b* has an overall axial dimension of about 0.370 inch and an outer diameter of 1.060 inch. The ring 8*b* has an annular flange 33 on which the multi-legged yoke 8*a* is supported. A notch 34 is formed on the output end of the yoke support ring 8*b*. The notch 34 facilitates use of a tool to thread the yoke support ring 8*b* with respect to the fitting 30 so as to compress the glass bulb 11 between the yoke 8*a* and the inlet seal assembly 13.

Figure 4:
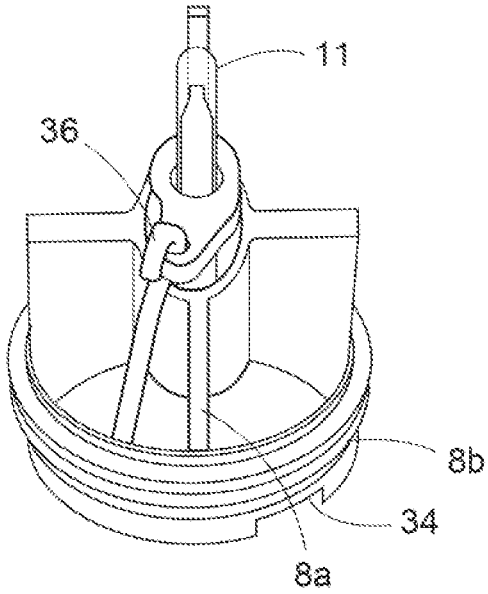
FIG. 4 shows an isometric view of the yoke, O-collar, linkage, and glass bulb shown in FIG. 3 viewed from the top and another side of the yoke.

Referring again to FIGS. 2, 3, and 4, a sliding, O-shaped collar 36 surrounds the glass bulb 11 between the angled edge 32 and the inlet seal cap assembly 13. The sliding collar 36 is connected to a collar rod 37 which extends axially in the outlet direction a predetermined distance past the flutes 31 of the yoke 8*a*. At its outlet end the collar rod 37 is terminated by a physical stop 38, which is constructed to interfere with the inlet biasing portion 4 during sprinkler activation. The collar rod 37 is constructed to transfer force to the collar 36 prior to sprinkler activation in order to break the glass bulb 11 so that the inlet seal cap assembly 13 can be released, as discussed further below.

As shown most clearly in FIG. 2, the inlet biasing portion 4 of the inlet 1 includes a first threaded tube 41, which houses an inlet compression spring 39 and a first spacer 40. The first threaded tube 41 has external threads at its inlet end which mate with internal threads of fitting 30. The first threaded tube 41 also has external threads that mate with internal threads of the inlet end 6 of flexible tube 3.

The first spacer 40 has an outer annular flange 40*a* and an inner annular flange 40*b* axially spaced by a frustoconical web 40*c*. The inlet compression spring 39 is retained between an annular flange 41*a* proximate the outlet end of the first threaded tube 41 and the outer annular flange of the first spacer 40. The first spacer 40 is biased axially by the inlet compression spring 39 towards the yoke support ring 8*b*. The web 40*c* has openings to permit fluid to pass therethrough. The inner annular flange 40*b* includes an opening though which the collar cable 37 passes.

The optimum spring force is established when the first threaded tube 41 is fully threaded into the fitting 30 to set a desired distance between the inner annular flange 40*b* of the first spacer 40 and the stop 38 of the collar rod 37. The desired distance "Z" set is termed the "inlet stroke", and, in one embodiment, is set to be greater than the axial deflection that the end of the linkage 10 would make when the flexible tube 3 and the linkage 10 are bent into two opposing 90 degrees, i.e., folded in shallow Z- or S-shapes. In an example embodiment, the inlet stroke Z is approximately 0.60 inch.

The flexible linkage 10 can be formed of wire or cable, such as braided stainless steel cable. In the preferred embodiment the flexible linkage 10 is formed of a 0.125 inch diameter braided stainless steel cable. Collars 10*a* (FIG. 2) and 10*b* (FIG. 7) are attached, respectively, at the inlet and outlet ends of the flexible linkage 10, such as, for example, by crimping. The collar 10*a* interferes with inner annular flange 40*b* of the first spacer 40. In the preferred embodiment, the inlet end of the flexible linkage 10 extends axially through the center of the inner annular flange 40*b* and is thus radially spaced from the inner wall of the first threaded tube 41 of the inlet biasing portion 4.

Referring again to FIG. 1, the flexible linkage 10 extends axially from the inlet biasing portion 4 through the flexible tube 3 to the outlet biasing portion 5 of the outlet 2. The outlet 2 includes the outlet biasing portion 5 and a sprinkler portion 42, which are connected together for example, by threaded connection.

Figure 7:
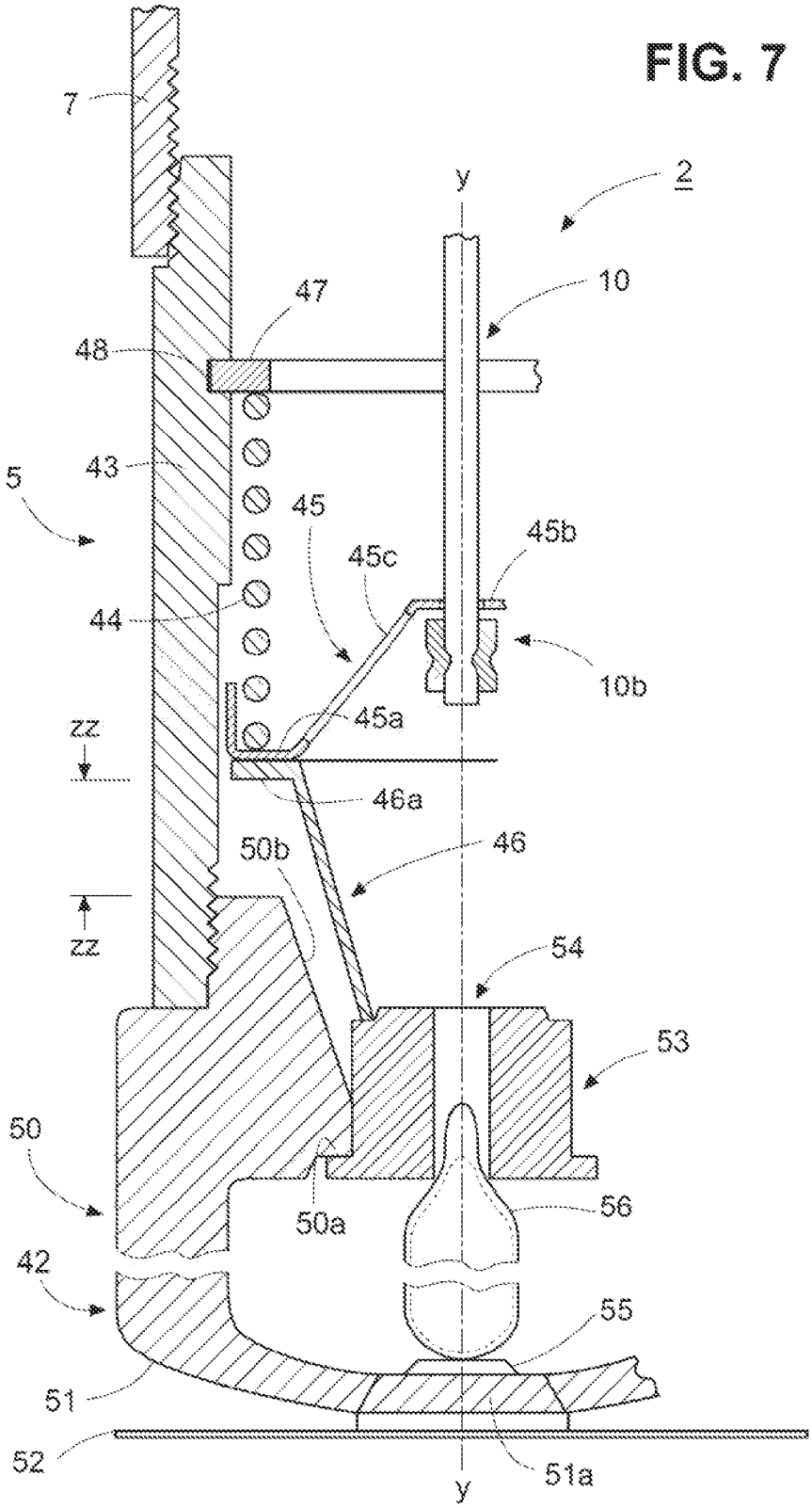
FIG. 7 shows an exploded cutaway section view through an outlet of the dry sprinkler shown in FIG. 1.

As shown in greater detail in FIG. 7, the outlet biasing portion 5 includes a second threaded tube 43 which houses an outlet compression spring 44, a second spacer 45 in contact with the outlet compression spring 44, and an orifice venturi 46 in contact with the second spacer 45. The second spacer 45 is constructed similarly to the first spacer 40. For example, the second spacer 45 has an inner annular flange 45*b* connected to an outer annular flange 45*a* by a frustoconical web 45*c*, which includes at least one opening to permit fluid to pass through the web 45*c*. The outlet end of the flexible linkage 10 passes through a central opening in the inner annular flange 45*b*. The outlet compression spring 44 biases the inner annular flange 45*b* to contact the collar 10*b* attached to the linkage 10.

In one embodiment, the outlet compression spring 44 is retained between an annular retaining ring 47 and the outer annular flange 45*a* of the second spacer 45. The retaining ring 47 is retained in a notch 48 formed in the inner wall of the second threaded tube 43. In another embodiment the outlet compression spring 44 is retained by an annular flange similar to 41*a* of first threaded tube 41, shown in FIG. 2. The outlet compression spring 44 biases the second spacer 45 in the outlet direction and into contact with a flange 46*a* of the orifice venturi 46. The orifice venturi 46 is supported by a sprinkler 42 of the outlet 2.

The sprinkler 42 of the outlet 2 is generally arranged as a conventional fire sprinkler and includes a threaded sprinkler body 50 constructed to mate with threads of the outlet of the second tube 43 in biasing portion 5, a frame 51 extending from the body in the output direction, and a deflector 52 supported by the frame 51 at a hub 51*a* thereof. The deflector 52 is constructed to distribute fluid issuing from the outlet 2 through orifice venturi 46. The sprinkler body 50 retains an orifice plug 53 that communicates with outlet orifice 54 in the outlet end of the orifice venture 46. The orifice plug 53 is retained in a set position by an annular flange 50*a* shown in FIG. 7 by a thermally responsive element 56, such as, for example, a glass bulb filled with a thermally responsive fluid. In one embodiment a glass bulb, having a nominal length of 20 mm, is used as the thermally responsive element 56. A set screw 55 in the hub 51*a* of the frame 51 is used to compress the glass bulb 56 against the orifice plug 53 to seat the plug 53 against the annular flange 50*a*. It will be appreciated by those of ordinary skill in the art that the particular details and configuration of the sprinkler 42 of the outlet 2 depend on the fire protection application and installation requirements of the dry sprinkler 100. For example, the sprinkler frame 51 and deflector 52 used will be different for sprinklers which are pendent than those which are intended as horizontal sidewall sprinklers. Thus, it should be understood that other suitable deflector arrangements may be substituted for the sprinkler 42 shown in FIG. 7.

After final assembly the orifice venturi 46 exerts a biasing force against the orifice plug 53. The distance ZZ between an outer flange 46*a* of the orifice venturi 46 and the inlet end of the body 50 of the sprinkler 42 is termed the outlet stroke ZZ, which is set by threading the body 50 with tube 43 of the outlet biasing portion 5. In one embodiment, the outlet stroke ZZ is set to be about 0.80 inch and the inlet stroke Z is set as discussed above to be about 0.60 inch.

The second threaded tube 43 has external threads at its inlet end for mating to internal threads of the flexible tube 3. The second threaded tube 43 also has internal threads for mating to the external threads of the sprinkler portion 42. The outlet 2 can be pre-assembled and attached as one modular unit to the outlet end 7 of the flexible tube 3.

When the flexible tube 3 bends, the flexible linkage 10 within the flexible tube 3 will also tend to deflect. However, due to internal diametrical and radial clearances of the flexible tube 3, when the flexible tube 3 is bent from, say, a straight configuration, in which the inlet stroke Z and outlet stroke ZZ distance are set, and in which the inlet 1, outlet 2, and flexible tube 3 are substantially in axial alignment, the ends of the flexible linkage 10 within the tube 3 will change positions relative to the ends of the flexible tube 3. For example, the ends of the linkage 10 will move longitudinally inward from the ends of the flexible tube 3 as the angular deflection of the flexible tube 3 increases. For example, if a flexible tube having a 20 inch length with a flexible linkage 10 of approximately the same length are bent into two opposing 90 degrees, i.e., folded into shallow Z- or S-shapes, the length of the flexible linkage 10 and tube 3 remain the same, but the ends of that linkage 10 shift inwardly by approx 0.50 inch with respect to the ends of the tube 3. By virtue of the foregoing example arrangement of the flexible dry sprinkler 100, the inlet and outlet compression springs, 39 and 44, respectively, will tolerate changes in the relative movement between the flexible linkage 10 and the flexible tube 3 without affecting the tautness of the linkage 10 due to field induced bending of the flexible tube 3. Accordingly, the inlet compression spring 39 inlet stroke Z is set sufficiently large to avoid fracture of the glass bulb 11 due to bending of the flexible tube 3.

The outlet compression spring 44 is constructed to be at least 1.5 times stronger than the opposing inlet compression spring 39 so that, as the flexible tube 3 is bent in a larger angle, the deflection of the ends of the linkage 10 is compensated for by the inlet compression spring 39 and not by the outlet compression spring 44.

In operation, in the event of a fire condition, heat from the fire will cause the thermally responsive element (i.e., the bulb 56) of the sprinkler 42 to respond. In the case where the thermally responsive element is a glass bulb filled with a thermally responsive fluid, as shown in FIG. 7, a temperature rise above a predetermined limit associated with the bulb 56 will cause the bulb 56 to rupture. When the glass bulb 56 ruptures, the compression on the orifice plug 53, and the force exerted by the outlet compression spring 44 on the orifice venturi 46 will also urge the orifice plug 53 in an outlet direction out of the outlet orifice 54, and the plug 53 will be ejected. The force exerted on the orifice venturi 46 by the outlet compression spring 44 forces the second spacer 45 and the linkage 10 to move from a first, inactivated position, through the outlet stroke into a second, activated position where the orifice venturi slides axially in the outlet direction until it is wedged into a frustoconical surface 50*b* formed in the body 50 of the sprinkler 42.

As the second spacer 45 moves to the second position, it pulls on the crimp 10*b* which in turn pulls on the first spacer 40 which compresses the inlet compression spring 39. The first spacer 40 continues to translate axially in the output direction causing the first spacer 40 to pull on the collar rod stop 38. When the collar rod 37 is pulled from the stop 38 by the first spacer 40, the rod 37 pulls on the collar 36 in a direction down the angled edge 32 of the yoke 8, which, in turn, rapidly snaps the collar 36 into the bulb 11, thereby breaking the bulb 11.

When the bulb 11 is broken, axial support for the inlet sealing cap assembly 13 is removed. Water pressure on the inlet side of the inlet sealing cap assembly 13 unseats the inlet sealing cap assembly 13 and initiates fluid flow through the inlet orifice 12. In one example embodiment, the collar rod 37 is constructed to engage the first spacer 40 when the first spacer 40 is displaced axially the stroke distance Z of 0.60 inch and the second spacer 45 is displaced axially a predetermined outlet stroke distance ZZ of 0.80 inch. The 0.20 inch difference between the inlet and outlet stroke distances represents a safety margin over the 0.60 inch shift of the taut flexible linkage 10 would experience merely by being bent to suit field installation. As a result of this example arrangement, the glass bulb 11 seated in the yoke 8 will not be broken, and the inlet seal cap assembly 13 will not be unseated, unless the second spacer 45 travels through the outlet stroke distance ZZ that is greater than the inlet stroke distance Z. Thus, inadvertent activation of the dry sprinkler 100 due to substantially large flexing of the sprinkler tube 3 can be avoided.

When the sprinkler 100 is activated, the inlet seal cap assembly 13 moves axially in the output direction, pivots on the pivot point 11*b*, and slides down the angled edge 32 of the yoke 8, whereupon the inlet seal cap assembly 13 is retained by the flutes 31 of the yoke 8. Fluid from the sprinkler system flows through the inlet orifice 12, around the retained inlet seal cap assembly 13, through the interior of the flexible tube 3 and out the outlet orifice 54 of the outlet 2 to the deflector 52, whereupon the fluid is distributed from the sprinkler 100.

While a dry sprinkler incorporating various combinations of the foregoing features provides the desired fast operation with full rated flow under at least some operating conditions, it has been found that adopting the above-described features all together results in a dry sprinkler that does so over a very wide range of rated flows (commonly expressed in the art in terms of the K factor) and of fluid pressures in the fluid supply conduit, in fact, from 7 psi to 175 psi.

Another aspect of the invention is a fire protection system utilizing one or more such dry sprinklers. The system includes a fluid supply in communication with at least one dry fire protection sprinkler. At least one of the dry fire protection sprinklers of the fire protection system is constructed as a flexible dry sprinkler in accordance with the foregoing description.

The attached drawings should be understood as being not to scale. Those drawings illustrate portions of embodiments of a dry sprinkler according to the present invention, and form part of the present application.

By virtue of the flexibility in the tube of the sprinkler, installation of the sprinkler system is facilitated because the sprinkler can be moved around building obstructions that would ordinarily require additional rigid plumbing. Moreover, because the flexible tube 3 is flexible, installers of the fluid supply can more easily accommodate variability or errors in the location of sprinkler drops in the ceiling of structures since the tube can be bent to properly position the sprinkler portion of the outlet where it is desired.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A flexible dry sprinkler comprising:

a flexible tube having a first end and a second end;

an inlet attached to the first end of the flexible tube, the inlet defining an inlet orifice operatively sealed by an inlet seal assembly;

an outlet attached to the second end of the flexible tube, the outlet defining an outlet orifice operatively sealed by an outlet seal assembly; and a flexible linkage extending between the inlet and the outlet through the flexible tube, the flexible linkage constructed to operatively release the inlet seal assembly responsive to axial translation of the flexible linkage from a first position to a second position, wherein the flexible linkage is supported by the outlet seal assembly in the first position and wherein the flexible linkage is constructed to axially translate toward the outlet when the outlet seal assembly is released, wherein the inlet includes a release unit constructed to operatively release the inlet seal assembly, wherein the flexible linkage is constructed to operate the release unit when the flexible linkage translates from the first position to the second position, wherein the outlet seal assembly includes a thermally responsive element and an outlet seal supported by the thermally responsive element, and wherein in a case where the thermally responsive element is in a responsive state, the outlet seal is released, wherein the inlet seal assembly is released in response to the flexible linkage translating in an outlet direction a predetermined distance to operate the inlet release mechanism, and wherein the release unit releases the inlet seal assembly responsive to translation of an inlet end of the linkage greater than a first stroke distance, and wherein the inlet seal assembly is released when an outlet end of the linkage translates a second stroke distance that is larger than the first stroke distance.

2. The sprinkler according to claim 1, wherein the first stroke distance is 0.6 inch and the second stroke distance is 0.8 inch.

3. The sprinkler according to claim 1, wherein the outlet includes a fire sprinkler which supports the thermally responsive element and the outlet seal.

4. The dry sprinkler according to claim 1, wherein the inlet release unit includes a glass bulb supported by a yoke, wherein the yoke is supported by the inlet, and wherein the glass bulb is retained between the yoke and the inlet seal assembly.

5. The dry sprinkler according to claim 4, wherein the release mechanism includes a collar surrounding the bulb, and a collar rod attached to the collar, wherein the collar rod is constructed to be displaced by the flexible linkage to break the bulb when the flexible linkage is displaced at least the predetermined distance.

6. The dry sprinkler according to claim 4, wherein the yoke has a sloped edge which intersects a seat of the glass bulb.

7. The dry sprinkler according to claim 1, wherein the inlet includes a connection portion for connection to a fluid supply.

8. The dry sprinkler according to claim 1, wherein the flexible tube is corrugated metal hose.

9. The dry sprinkler according to claim 1, wherein the inlet includes an inlet biasing member constructed to bias the flexible linkage in an inlet direction, and wherein the outlet includes an outlet biasing member constructed to bias the flexible linkage in the outlet direction.

10. The dry sprinkler according to claim 9, wherein the inlet biasing member is an inlet compression spring and the outlet biasing member is an outlet compression spring, wherein the spring constant of the outlet compression spring is greater than the spring constant of the inlet compression spring.

11. The dry sprinkler according to claim 10, wherein the outlet compression spring is at least 1.5 times stronger than the inlet compression spring.

12. The dry sprinkler according to claim 10, wherein the flexible linkage is attached to the inlet biasing member at an inlet end of the flexible linkage and the flexible linkage is attached to the outlet biasing member at an outlet end of the flexible linkage, and wherein the flexible linkage is retained in tension between the inlet and outlet biasing members.

13. A flexible dry sprinkler system comprising:

one or more flexible dry sprinklers comprising:

a flexible tube having a first end and a second end, an inlet attached to the first end of the flexible tube, the inlet defining an inlet orifice operatively sealed by an inlet seal assembly, an outlet attached to the second end of the flexible tube, the outlet defining an outlet orifice operatively sealed by an outlet seal assembly, and a flexible linkage extending between the inlet and the outlet through the flexible tube, the flexible linkage constructed to operatively release the inlet seal assembly responsive to axial translation of the flexible linkage from a first position to a second position, wherein the flexible linkage is supported by the outlet seal assembly in the first position and wherein the flexible linkage is constructed to axially translate toward the outlet when the outlet seal assembly is released; and a fluid supply conduit in fluid communication with a fluid source and in fluid communication with the one or more flexible dry sprinklers, wherein the inlet includes a release unit constructed to operatively release the inlet seal assembly, wherein the flexible linkage is constructed to operate the release unit when the flexible linkage translates from the first position to the second position, wherein the outlet seal assembly includes a thermally responsive element and an outlet seal supported by the thermally responsive element, and wherein in a case where the thermally responsive element is in a responsive state, the outlet seal is released and fluid from the fluid supply is discharged through the outlet orifice, wherein the inlet seal assembly is released in response to the flexible linkage translating in an outlet direction a predetermined distance to operate the inlet release mechanism, wherein the inlet includes an inlet biasing member constructed to bias the flexible linkage in an inlet direction, and wherein the outlet includes an outlet biasing member constructed to bias the flexible linkage in the outlet direction, and wherein the inlet biasing member is an inlet compression spring and the outlet biasing member is an outlet compression spring, wherein the spring constant of the outlet compression spring is greater than the spring constant of the inlet compression spring.

14. The flexible dry sprinkler system according to claim 13, wherein the fluid supply conduit is fluidly coupled to each inlet of the respective one or more flexible dry sprinklers.

15. The flexible dry sprinkler system according to claim 13, wherein the outlet includes a fire sprinkler which supports the thermally responsive element and the outlet seal.

16. The flexible dry sprinkler system according to claim 13, wherein the inlet release unit includes a glass bulb supported by a yoke, wherein the yoke is supported by the inlet, and wherein the glass bulb is retained between the yoke and the inlet seal assembly.

17. The flexible dry sprinkler system according to claim 16, wherein the release mechanism includes a collar surrounding the bulb, and a collar rod attached to the collar, wherein the collar rod is constructed to be displaced by the flexible linkage to break the bulb when the flexible linkage is displaced at least the predetermined distance.

18. The flexible dry sprinkler system according to claim 16, wherein the yoke has a sloped edge which intersects a seat of the glass bulb.

19. The flexible dry sprinkler system according to claim 13, wherein the inlet includes a connection portion for connection to the fluid supply conduit.

20. The flexible dry sprinkler system according to claim 13, wherein the flexible tube is corrugated metal hose.

21. A flexible dry sprinkler comprising:

a flexible tube having a first end and a second end;

an inlet attached to the first end of the flexible tube, the inlet defining an inlet orifice operatively sealed by an inlet seal assembly;

an outlet attached to the second end of the flexible tube, the outlet defining an outlet orifice operatively sealed by an outlet seal assembly; and a flexible linkage extending between the inlet and the outlet through the flexible tube, the flexible linkage constructed to operatively release the inlet seal assembly responsive to axial translation of the flexible linkage from a first position to a second position, wherein the flexible linkage is supported by the outlet seal assembly in the first position and wherein the flexible linkage is constructed to axially translate toward the outlet when the outlet seal assembly is released, wherein the inlet includes an inlet biasing member constructed to bias the flexible linkage in an inlet direction, and wherein the outlet includes an outlet biasing member constructed to bias the flexible linkage in the outlet direction, and wherein the inlet biasing member is an inlet compression spring and the outlet biasing member is an outlet compression spring, wherein the spring constant of the outlet compression spring is greater than the spring constant of the inlet compression spring.

* * * * *